US010688331B1

(12) United States Patent
Strawderman et al.

(10) Patent No.: US 10,688,331 B1
(45) Date of Patent: Jun. 23, 2020

(54) POLE VAULT PIT CONSTRUCTION

(71) Applicants: Mark Strawderman, Cranston, RI (US); Gregory Hull, Phoenix, AZ (US)

(72) Inventors: Mark Strawderman, Cranston, RI (US); Gregory Hull, Phoenix, AZ (US)

(73) Assignee: MFAC, LLC, West Warwick, RI (US)

( * ) Notice: Subject to any disclaimer, the term of this patent is extended or adjusted under 35 U.S.C. 154(b) by 110 days.

(21) Appl. No.: 16/009,399

(22) Filed: Jun. 15, 2018

(51) Int. Cl.
*A63B 6/02* (2006.01)
*A63B 5/06* (2006.01)

(52) U.S. Cl.
CPC . *A63B 6/02* (2013.01); *A63B 5/06* (2013.01)

(58) Field of Classification Search
CPC ..... A63B 6/02; A63B 5/06; A63B 6/00–025; A63B 5/00–06; A63B 2005/085; A63B 2244/08–088
See application file for complete search history.

(56) References Cited

U.S. PATENT DOCUMENTS 3,391,414 A * 7/1968 Gordon ..... A47B 27/08 5/420
3,513,491 A * 5/1970 Gordon ..... C08G 18/2875 5/420
3,892,401 A * 7/1975 Sorenson ..... A63B 6/02 482/15
3,892,402 A * 7/1975 Montour ..... A63B 6/02 482/15
3,965,507 A * 6/1976 Reiland ..... A63B 6/02 482/18
4,168,061 A * 9/1979 Gordon ..... A63B 6/02 482/15
4,215,857 A * 8/1980 Gordon ..... A63B 6/02 482/15
4,245,838 A * 1/1981 Gordon ..... A63B 6/02 482/15
4,443,009 A * 4/1984 Smith ..... A63B 5/06 482/15
5,964,634 A * 10/1999 Chang ..... A47C 13/005 446/111
6,568,981 B1 * 5/2003 Chang ..... A63H 33/048 24/306
7,736,274 B2 * 6/2010 Thibodeaux, Sr. ..... A63B 5/06 482/15
8,444,531 B1 * 5/2013 Johnson ..... A63B 5/06 482/14

(Continued)

*Primary Examiner* — Andrew S Lo
(74) *Attorney, Agent, or Firm* — Salter & Michaelson

(57) ABSTRACT

A pole vault pit construction that is formed of multiple resilient foam blocks that are secured in a unitary manner and wherein thee construction is comprised of a front cutout section defining a recess for receiving a pole engager, said front cutout section having an open front end and an inner end, and a contiguous rear landing section. The plurality of foam blocks of the front cutout section include at least one pair of opposed position blocks each having a tapered surface commencing from the upper surface downwardly to the lower surface and in a direction toward the opposed position block so that a cross-section of the recess is essentially trapezoidal. The rear landing section includes at least a center foam block having an uninterrupted tapered surface commencing from the upper surface downwardly to the lower surface and in a direction toward the open front end of the recess.

22 Claims, 11 Drawing Sheets

(56) References Cited

U.S. PATENT DOCUMENTS

| | | | | |
|---|---|---|---|---|
| 9,539,457 | B2 | 1/2017 | Schwartz et al. | |
| 9,566,462 | B2 * | 2/2017 | Schwartz | A63B 5/06 |
| 9,707,425 | B2 * | 7/2017 | Schwartz | A63B 5/06 |
| 2003/0153243 | A1 * | 8/2003 | Haas | A63H 33/048 446/85 |
| 2004/0170792 | A1 * | 9/2004 | Roberts | A44B 18/0073 428/40.1 |
| 2015/0231435 | A1 * | 8/2015 | Schwartz | A63B 6/02 482/18 |
| 2015/0238820 | A1 * | 8/2015 | Langer | B32B 7/08 482/142 |
| 2015/0343249 | A1 * | 12/2015 | Gurley | A63B 5/11 482/27 |
| 2016/0296850 | A1 * | 10/2016 | Scaccia | A63H 33/048 |
| 2019/0070481 | A1 | 3/2019 | Schwartz | |

* cited by examiner

POLE VAULT PIT CONSTRUCTION

FIELD OF THE INVENTION

The present invention relates to an improvement in the construction of a pole vault pit. More particularly, the present invention relates to an improved construction of a pole vault mat where the construction is meant to particularly prevent injuries to the athlete.

BACKGROUND OF THE INVENTION

Pole vault pits or mats are generally comprised of multiple resilient pieces that may be constructed of a foam-type material. One example of a block construction for a pole vault pit is found in U.S. Pat. No. 9,539,457 to Schwartz et al. The problem with existing arrangements is that the block construction is such that there is a substantial risk of injury primarily because of a seam that is provided between blocks particularly at the far end of the pit recess.

Another U.S. Pat. No. 8,445,431 to Johnson et al. is directed at reducing the risk of injury. However, this particular reference does not have anything to do with the pit construction itself. In this patent the arrangement is meant to protect the area around the pit box and outside of the pit area.

In connection with identifying the "seam" reference may now be made to FIGS. 1-3 of the present application which illustrates an existing construction. This pit construction 10 includes a front cutout section 12 and a contiguous rear landing section 14. A cover 15 is also shown disposed over the series of blocks. Without going into great detail regarding the construction of the individual blocks, it is important to note that the main problem area relates to the opposed pair of blocks B1 of the front cutout section. As indicated in FIGS. 2 and 3, this portion of the construction forms a seam at 16 that has been found to cause injury particularly upon engagement of the pole at that area. The longitudinal slot or seam 16, as noted in particular in FIG. 3, is contiguous with opposed lateral seams 16A and 16B, which provide potential additional injury areas.

It is an object of the present invention to provide an improved pole vault pit construction that is particularly adapted to reduce injuries when the pole vaulter inadvertently breaks through a seam created by the blocks.

A further object of the present invention is to provide an improved pole vault pit construction where the inside end of the recess is essentially formed of a one-piece tapered block without any seams.

Still another object of the present invention is to provide an improved pole vault pit construction that eliminates a main threat area of injury particularly where the pole vaulter runs through or lands.

SUMMARY OF THE INVENTION

To accomplish the foregoing and other objects, features and advantages, the present invention describes a pole vault pit construction that is formed of multiple resilient foam blocks that are secured in a unitary manner and wherein thee construction is comprised of a front cutout section defining a recess for receiving a pole engager, said front cutout section having an open front end and an inner end, and a contiguous rear landing section. Each of the front cutout section and contiguous rear landing section includes a plurality of foam blocks. Each of the foam blocks includes a lower surface and an upper surface, adjacent ones of said foam blocks being secured together. The plurality of foam blocks of the front cutout section include at least one pair of opposed position blocks each having a tapered surface commencing from the upper surface downwardly to the lower surface and in a direction toward the opposed position block so that a cross-section of the recess is essentially trapezoidal. The rear landing section includes at least a center foam block having a tapered surface commencing from the upper surface downwardly to the lower surface and in a direction toward the open front end of the recess. The tapered surface on the center foam block is uninterrupted so as to form a single tapered surface at the inner end of the recess. This construction avoids past problems of the pole possibly engaging with spaced apart blocks at the deep end of the recess.

Other aspects of the present invention include having the securing of adjacent blocks is by means of one or more buckles that connect between adjacent side walls of respective adjacent blocks; wherein each buckle includes a male piece and a female piece; wherein each buckle is disposed on an outer facing side wall of respective adjacent blocks; wherein the securing of adjacent blocks is further provided by adhering strips that are disposed along a top edge of adjacent blocks; wherein the securing of adjacent blocks is provided by having a separate adhering strip that connects across the adjacently disposed adhering strips on the top edge of adjacent blocks; wherein all adhering strips are hook-and-loop fastener strips; wherein the securing of adjacent blocks is further provided by adhering strips that are disposed along a top edge of adjacent blocks; wherein the securing of adjacent blocks is provided by having a separate adhering strip that connects across the adjacently disposed adhering strips on the top edge of adjacent blocks; including a thin cover that is disposed over the pit construction; wherein the blocks of the front cutout section include a front pair of blocks that have facing tapers defining a front portion of the recess and an adjacent rear pair of blocks that also have facing tapers defining a rear portion of the recess; wherein each of the rear pair of blocks of the front cutout section also includes a triangular member that coincides with the tapered surface of the center foam block of the rear landing section; wherein the height of the rear landing section is greater than the height of the front cutout section; and wherein the triangular member of the rear pair of blocks of the front cutout section also includes a tapered surface that transitions from the height of the rear landing section to the height of the front cutout section.

Also in accordance with the present invention there is provided a construction of a pole vault mat providing the mat with a front cutout section defining a recess for receiving a pole engager, said front cutout section having an open front end and an inner end, and a contiguous rear landing section. Each of the front cutout section and contiguous rear landing section includes a plurality of foam blocks, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal. The rear landing section includes at least a center foam block having a tapered surface commencing from the upper surface downwardly to the lower surface and in a direction toward the open front end of the recess. The tapered surface of the center foam block is continuous so as to form a single tapered surface at the inner end of the recess. This construction eliminates problems with the pole inadvertently engaging with the landing section.

Still other aspects of the present invention include having the tapered surface of the center foam block as a contiguous flat surface that defines the complete inner end of the recess; the entire tapered surface of the center foam block as extends between the tapered surfaces of the opposed blocks of the front cutout section is without any gaps; wherein the securing of adjacent blocks is by means of one or more buckles that connect between adjacent side walls of respective adjacent blocks, and wherein the securing of adjacent blocks is further provided by adhering strips that are disposed along a top edge of adjacent blocks; wherein the blocks of the front cutout section include a front pair of blocks that have facing tapers defining a front portion of the recess and an adjacent rear pair of blocks that also have facing tapers defining a rear portion of the recess, and wherein each of the rear pair of blocks of the front cutout section also includes a triangular member that coincides with the tapered surface of the center foam block of the rear landing section; and wherein the height of the rear landing section is greater than the height of the front cutout section, and wherein the triangular member of the rear pair of blocks of the front cutout section also includes a tapered surface that transitions from the height of the rear landing section to the height of the front cutout section.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Reference is now made to FIGS. 4-11 for an illustration of a preferred block arrangement. The various blocks are connected by means of a series of buckles K. Further interlocking of the blocks is performed by using adhering strips such as velcro strips. These strips may be identified as strips S (FIG. 6) used to maintain the cover in place or strips P (FIG. 9) that assist in holding adjacent blocks together. For an illustration of both the strips S and strips P refer to the exploded plan view of FIG. 9. The cover 25 may be constructed of a thin fabric material that provides a good basis for adhering with the strips S.

Figure 1:
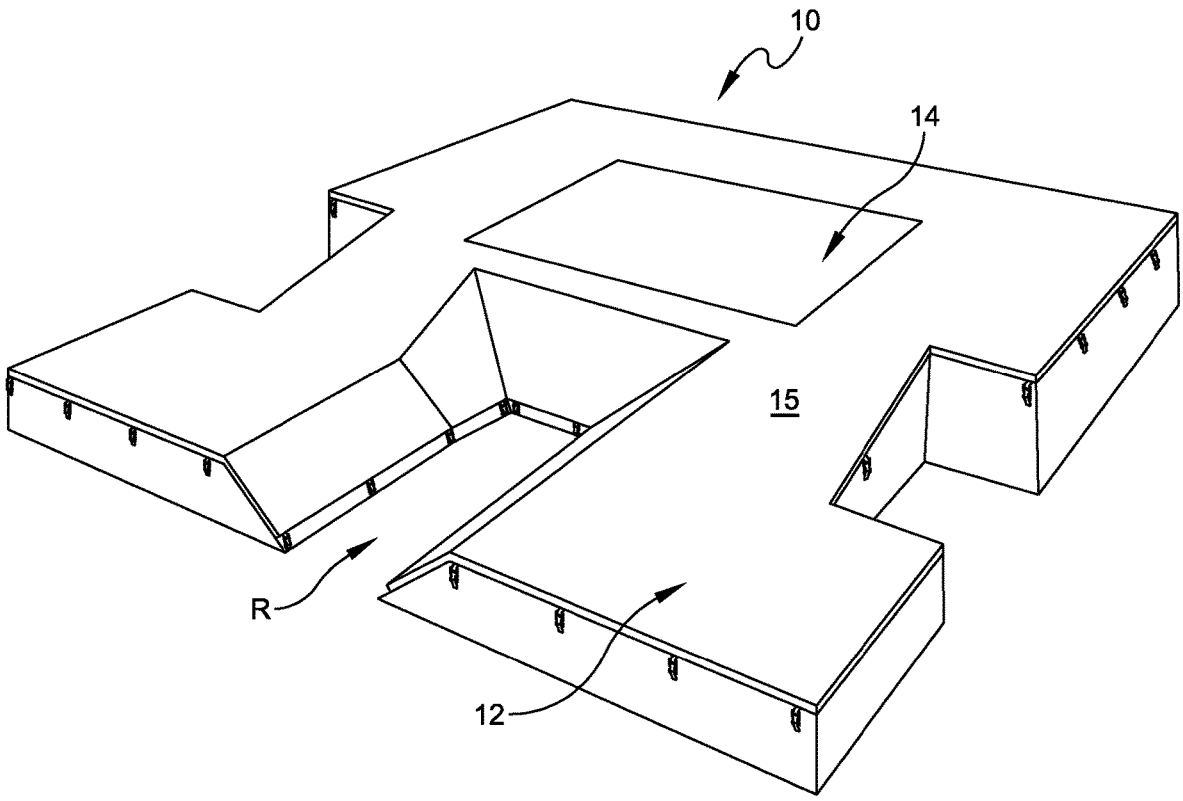
FIG. 1 (PRIOR ART)
FIG. 1 is a perspective view of a prior art pit construction.
Figure 2:
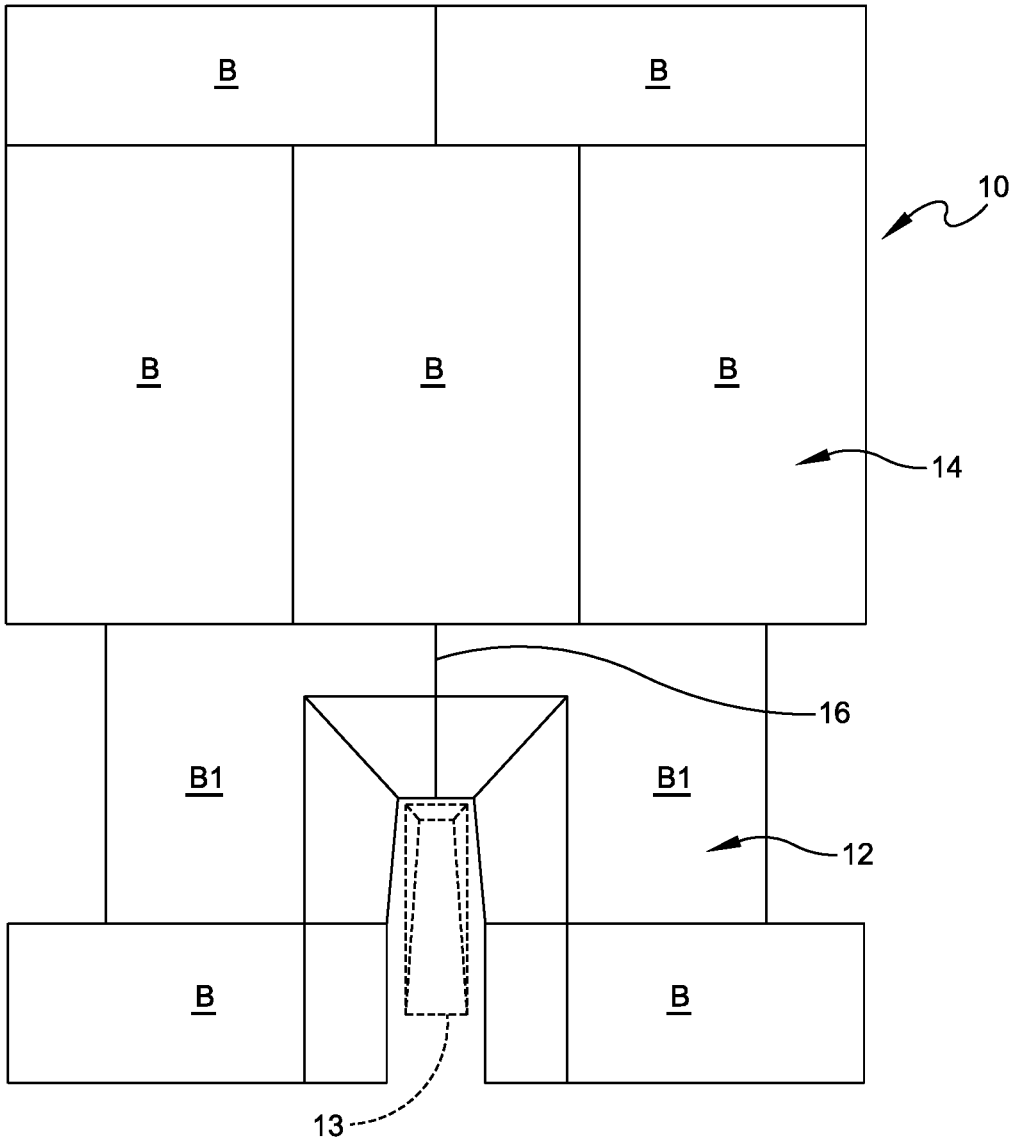
FIG. 2 (PRIOR ART)
FIG. 2 is a plan view of the blocks that are typically used with this type of construction.
Figure 3:
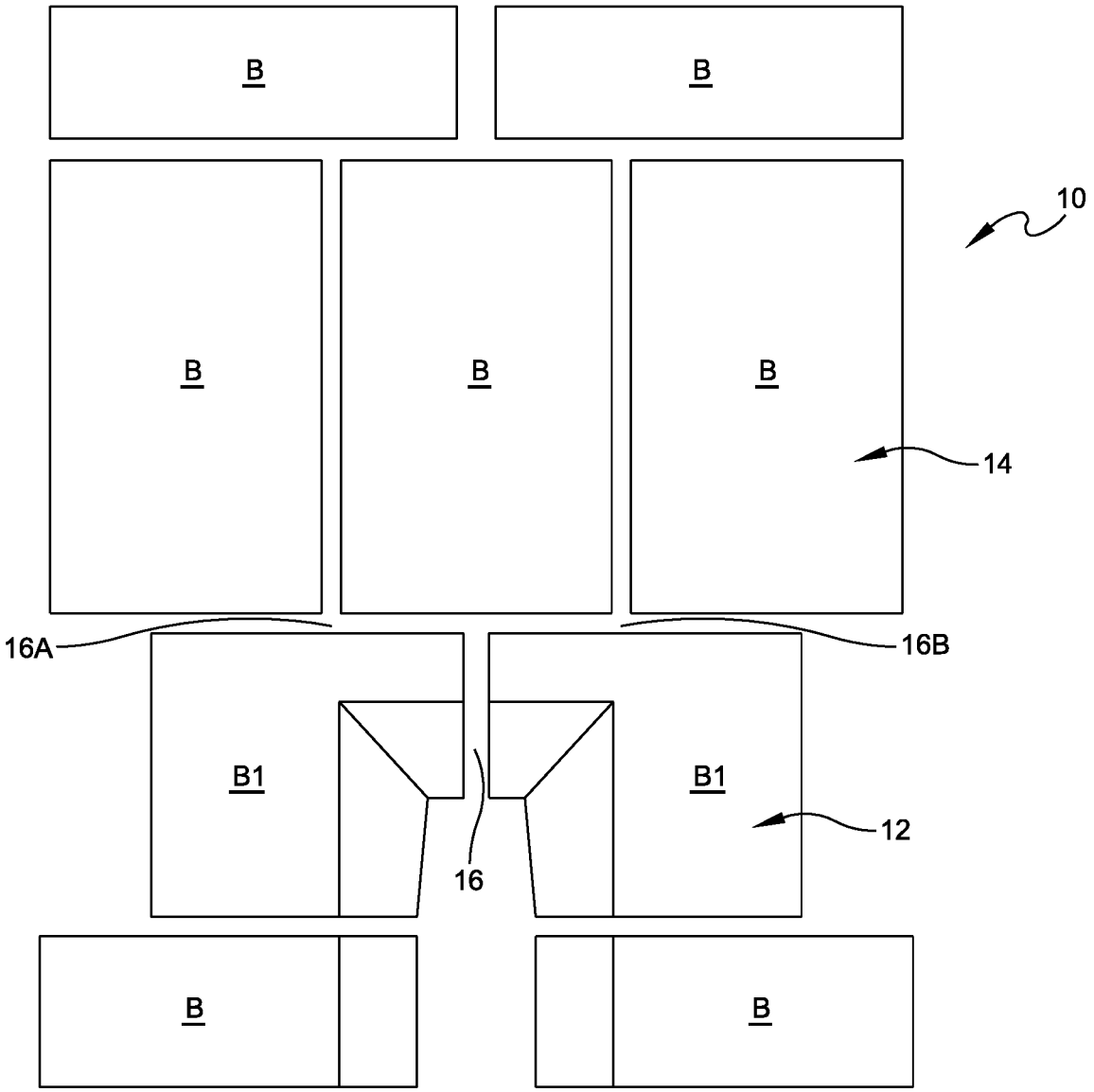
FIG. 3 (PRIOR ART)
FIG. 3 is a plan view that is partially exploded to clearly illustrate the seam 16 between blocks B1.
Figure 4:
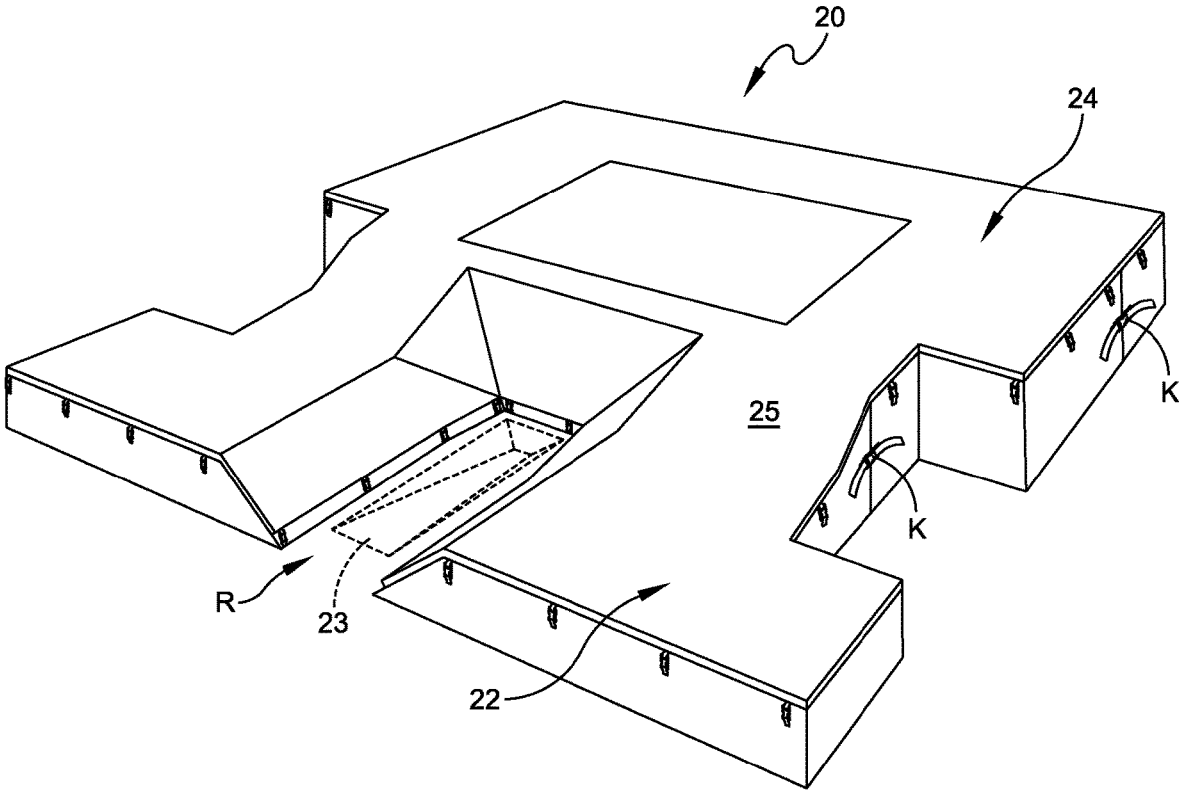
FIG. 4 is a perspective view of the pole vault pit construction of the present invention with the use of a cover over the blocks.

The pole vault construction 20 is thus formed of multiple resilient foam blocks that are secured in a unitary manner. In, for example, FIGS. 5 and 6, there may be considered to be blocks B associated with a front cutout section 22 and a further series of blocks L that define the contiguous rear landing section 24. In FIG. 4 the cover is shown in place at 25. FIG. 4 also illustrates some of the buckles at K. Moreover, FIG. 4 illustrates at 23, in dotted outline, what may be considered as a pole engager that is disposed within the recess R. This is the area where the pole vaulter engages with the pole.

Figure 5:
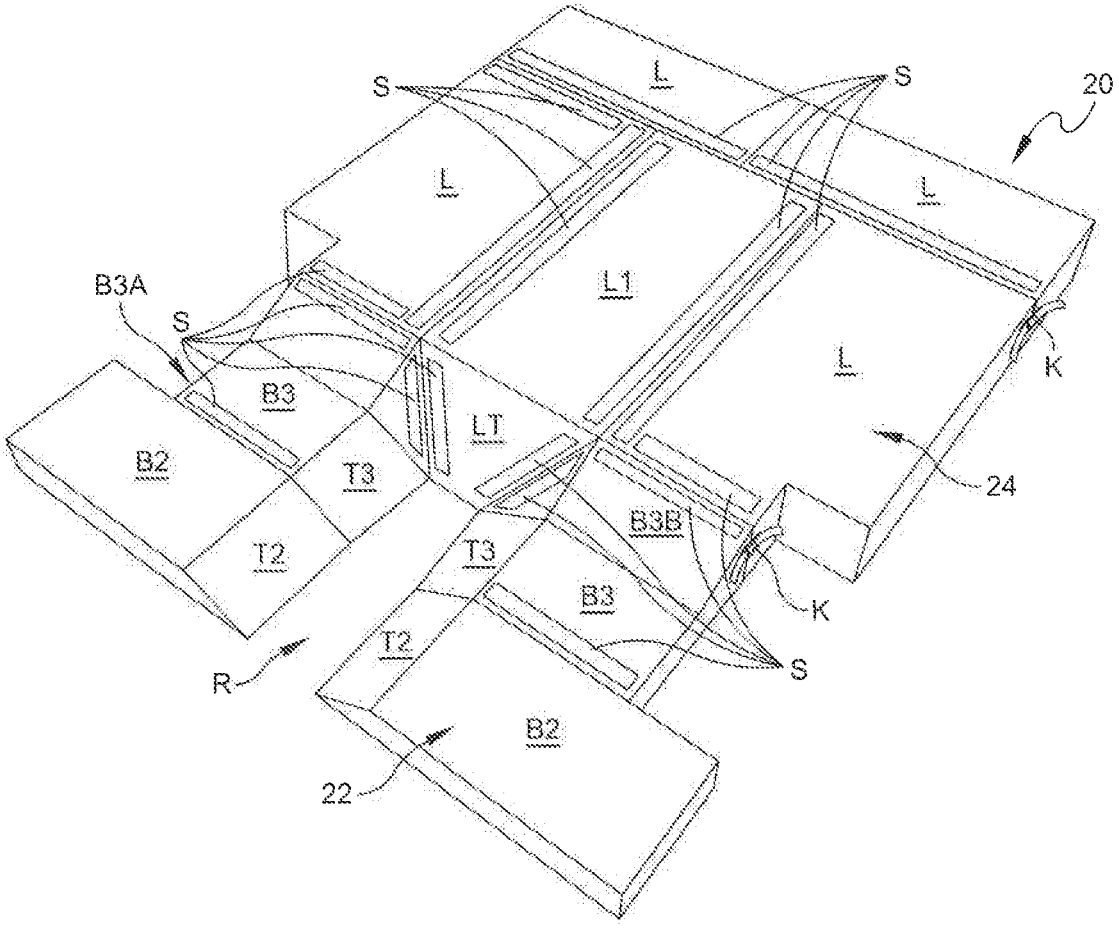
FIG. 5 is a perspective view with the cover removed illustrating the various blocks that are used.
Figure 6:
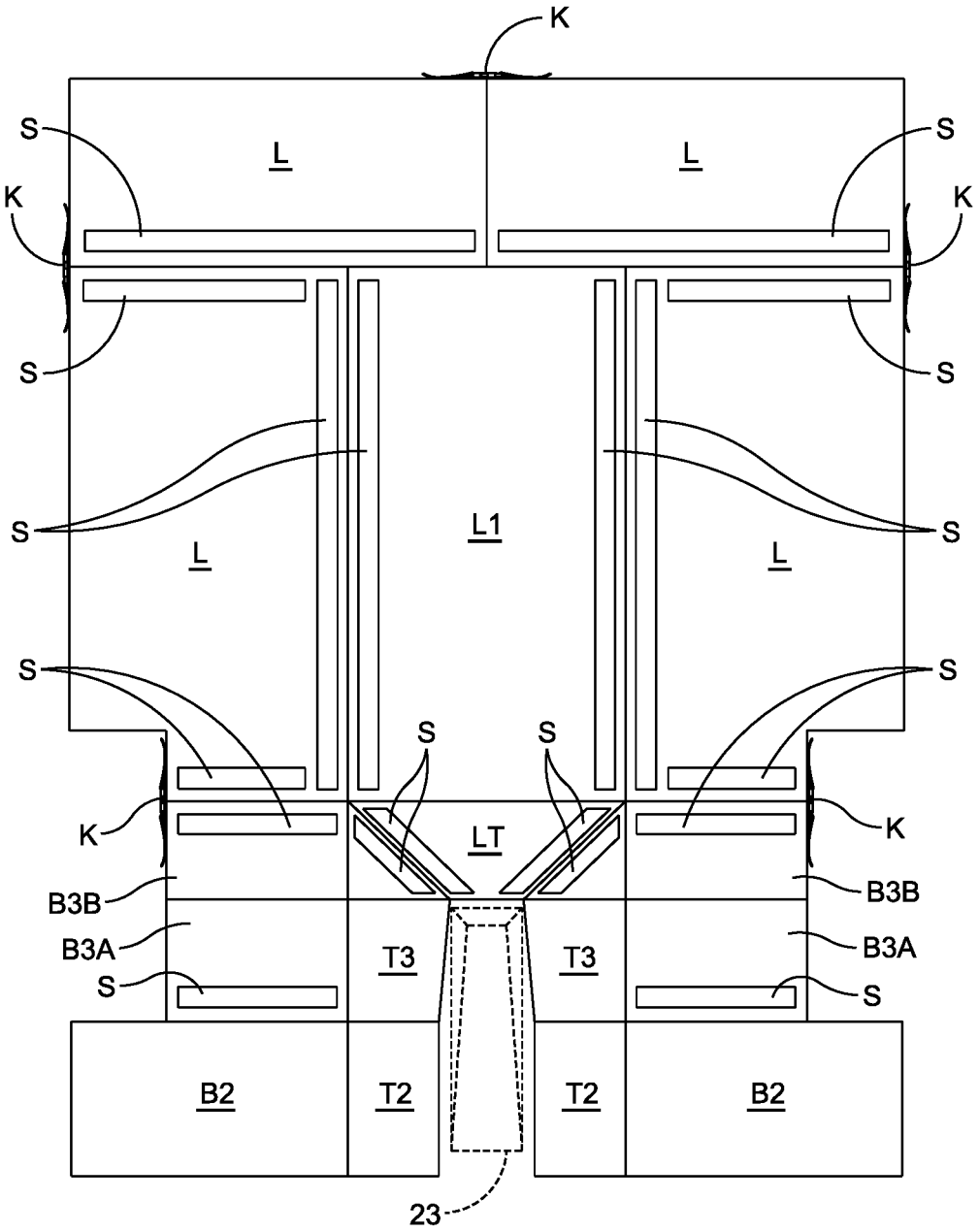
FIG. 6 is a plan view of the block arrangement of FIG. 5.
Figure 7:
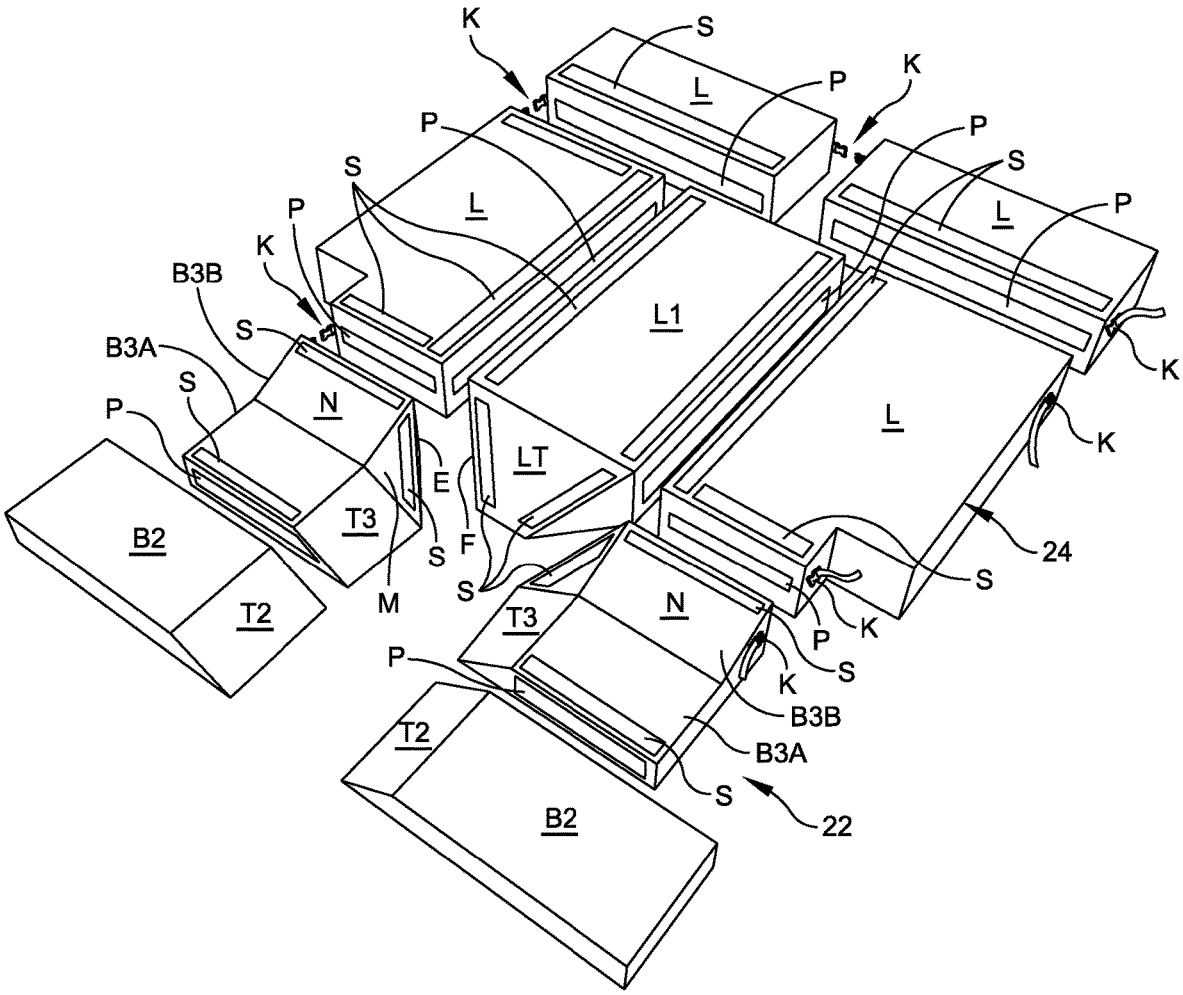
FIG. 7 is an exploded perspective view showing further details of the pit construction of FIGS. 4 and 5.
Figure 8:
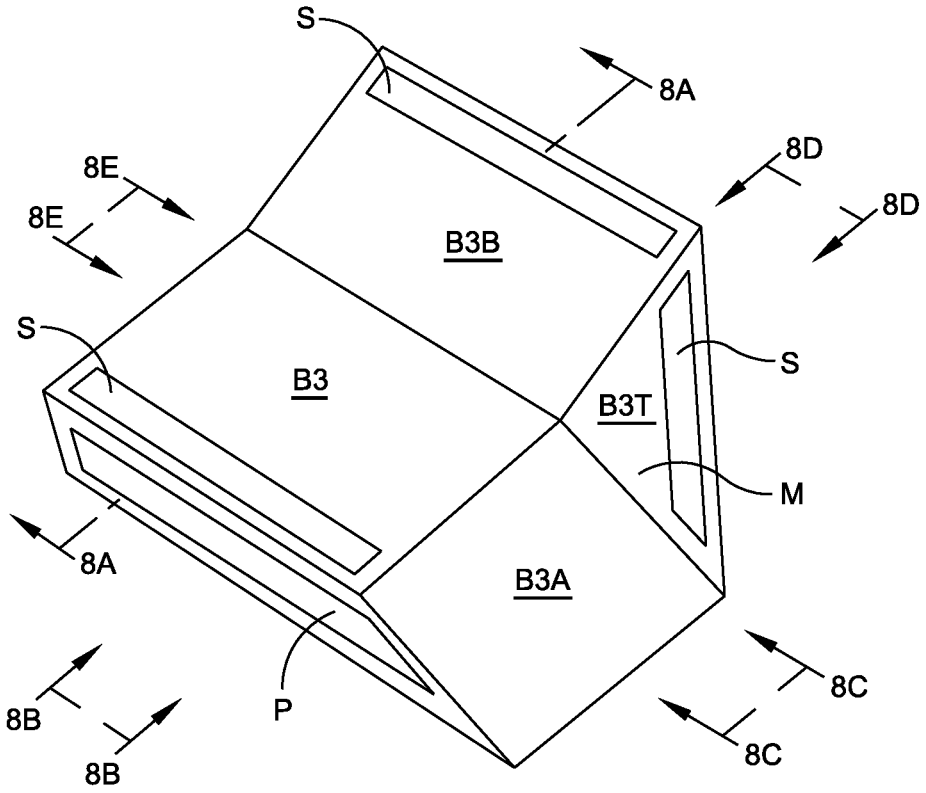
FIG. 8 is a perspective view of one of the blocks that engages with a center landing section.
Figure 8A:
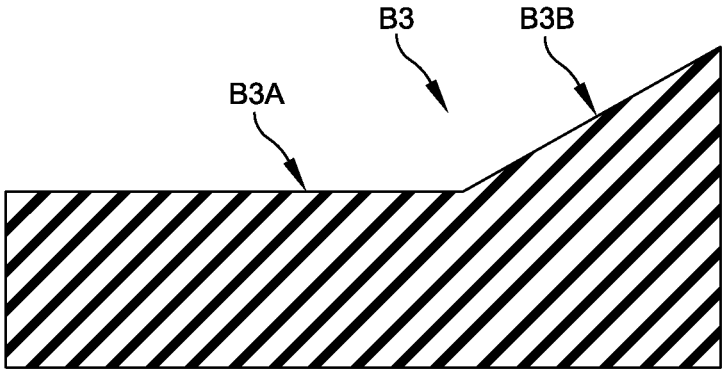
FIG. 8A is a cross sectional view taken along line 8A-8A of FIG. 8.
Figure 8B:
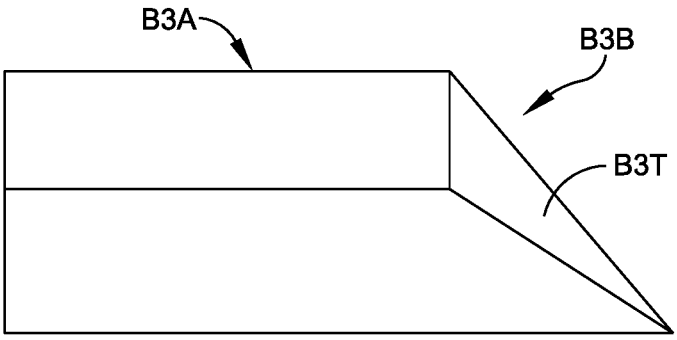
FIG. 8B is a view taken along line 8B-8B of FIG. 8
Figure 8C:
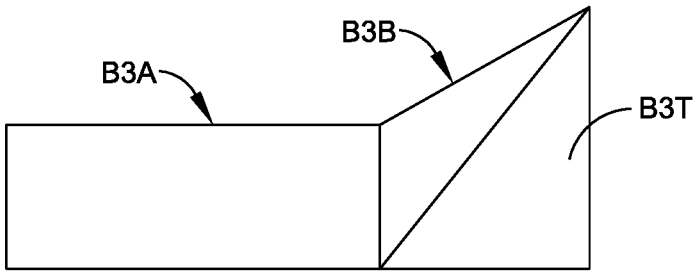
FIG. 8C is a view taken along line 8C-8C of FIG. 8
Figure 8D:
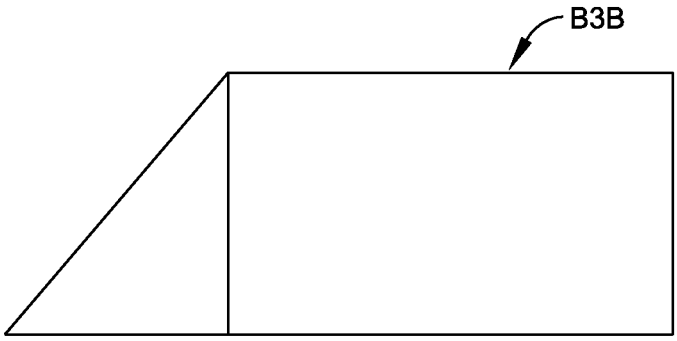
FIG. 8D is a view taken along line 8D-8D of FIG. 8.
Figure 8E:
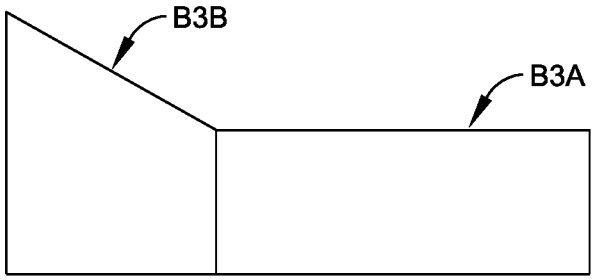
FIG. 8E is a view taken along line 8E-8E of FIG. 8.

Thus, the front cutout section 22 defines a recess R for receiving the pole engager 23. Each of the foam blocks may be considered as including a lower surface and an upper surface with adjacent ones of the foam blocks being secured together preferably by means of both buckles K and adhering strips P. For the plurality of foam blocks of the front cutout section 22, such as illustrated in FIGS. 5-7, there is included at least one pair of opposed position blocks having a tapered surface commencing from the upper surface of the block downwardly to the lower surface and in a direction toward the opposed position block. A cross section through those blocks such as blocks B2 in FIGS. 5 and 6 defines a somewhat trapezoidal recess, actually an upside down trapezoidal recess. The blocks B2 are also illustrated as having the tapered surface T2. The blocks B3 are also illustrated as having the tapered surface T3.

The rear landing section 24 is shown as being comprised of five separate blocks L with the most significant of these blocks being the center block L1. Note that the center block L1 has a tapered surface LT commencing from the upper surface downwardly to the lower surface and in a direction toward the open front end of the recess R. The tapered surface LT of the center block L1 is provided without any seam and is essentially uninterrupted so as to form a single tapered surface at the very inner end of the recess R. This construction avoids past problems of the pole potentially engaging in a seam between blocks at the inner end of the recess and causing an injury. The tapered surface LT is preferably a continuous flat surface that defines the complete inner end of the recess R. This entire surface LT extends between the tapered surfaces of the opposed blocks B3 of the front cutout section and is without any gaps.

The front cutout section 22 in the illustrated embodiment includes a front pair of blocks B2 that have facing tapered surfaces T2 and thus define a front portion of the recess R. The front cutout section 22 further includes an adjacent rear pair of blocks B3. Each of the blocks B3 may be considered as having separate block sections B3A with a corresponding tapered surface T3 and a more triangular shaped section B3B. It is the edge E of the block section B3B that engages with an edge F of the tapered surface LT. In this regard refer to FIG. 7 showing the corresponding position edges E and F. The same arrangement also applies to the other opposite position block section B3B. Thus, each of the rear pair of blocks B3B includes a triangular member M that coincides with the tapered surface F of the center foam block of the rear landing section 24.

It is furthermore noted that the height of the rear landing section 24 is greater than the height of the front cutout section 22. Thus, the triangular member M of the rear pair of blocks of the front cutout section also has a tapered surface N that transitions from the height of the rear landing section to the height of the front cutout section.

Figure 9:
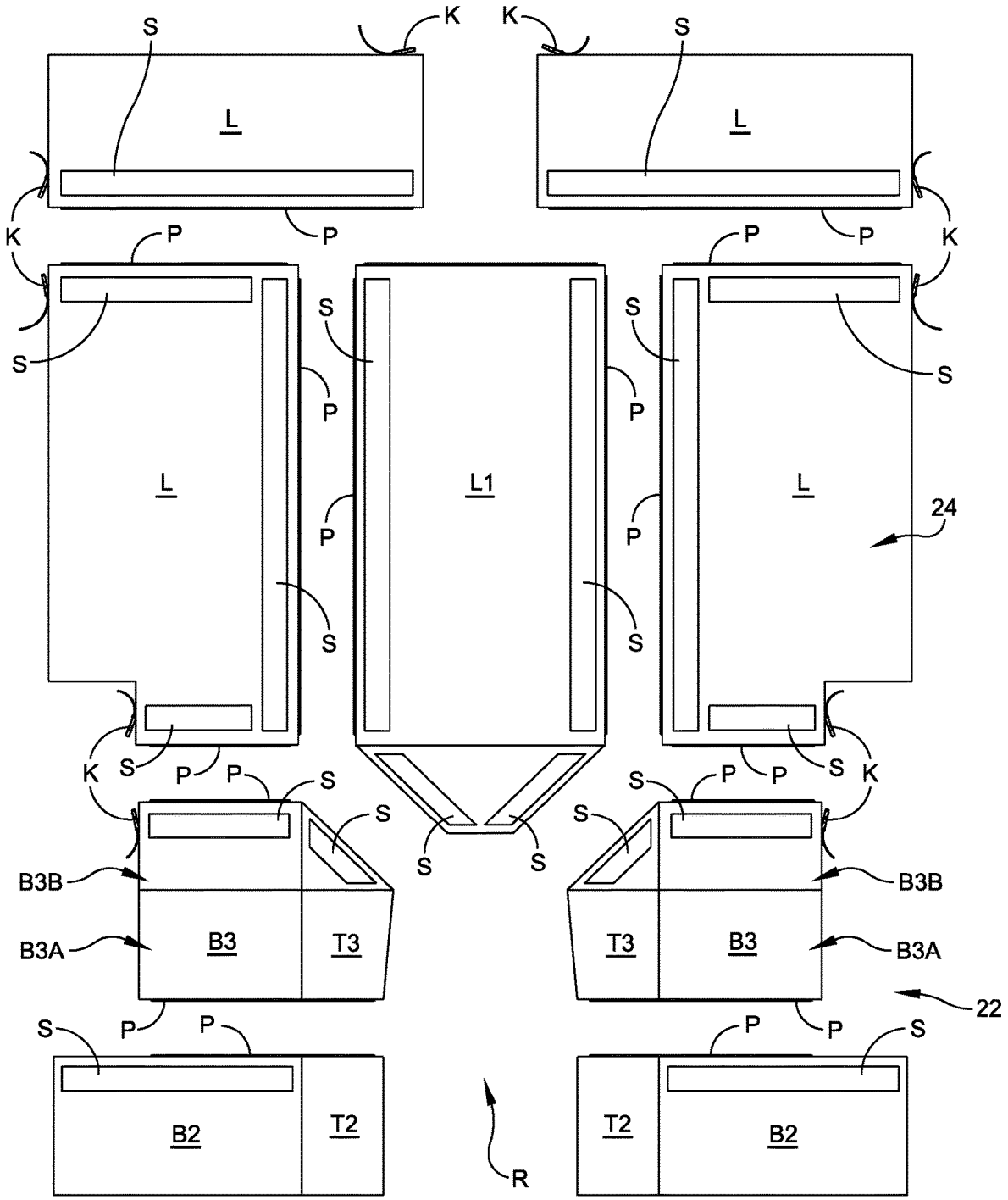
FIG. 9 is an exploded plan view related to FIGS. 6 and 7 and showing use of various adhering strips.
Figure 10:
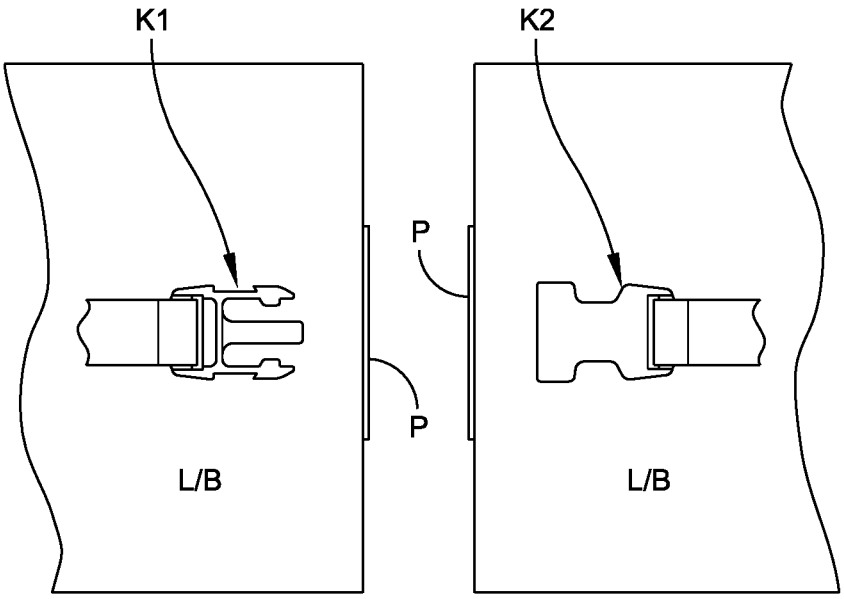
FIG. 10 is a simplified diagram showing a typical buckle arrangement with the buckle uncoupled.
Figure 11:
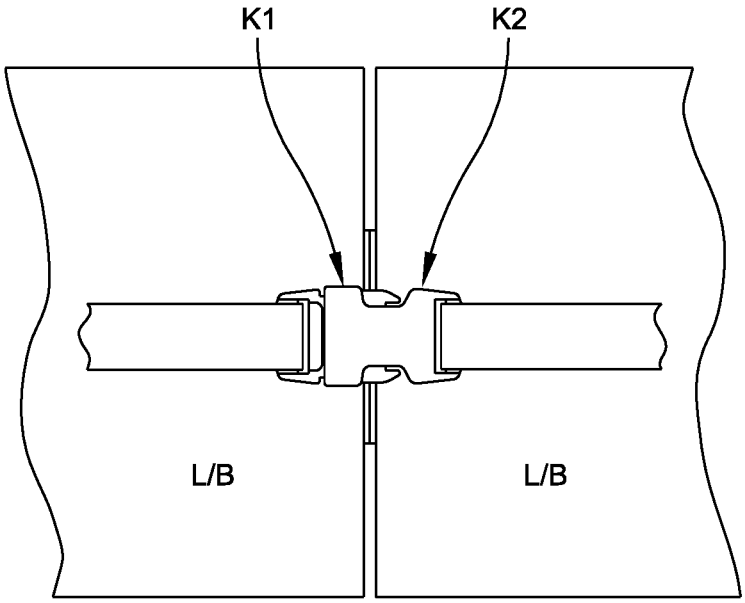
FIG. 11 is a view related to FIG. 10 with the buckle connected.

As illustrated in, for example, FIGS. 7 and 9, the securing of adjacent blocks may be by means of one or more buckles K that connect between adjacent sidewalls of respective adjacent blocks. In FIG. 9 because this is an exploded view, the buckles K would be considered as having male and female ends. FIGS. 10 and 11 illustrate one construction which includes a male connector K1 and a female connector K2. In the plan view of FIG. 9 buckle arrangements are used at three locations regarding the rear landing section 24. There are also opposed buckles K for connecting one of the blocks L of the rear landing section with the blocks B3.

The securing of adjacent blocks is also preferably provided by means of adhering strips. In connection with the plan view of FIG. 9, each of these strips is of somewhat elongated shape and may be comprised of a velcro strip. The upwardly facing strips S are used primarily to secure the cover 25 in place. However, as also illustrated in FIG. 9, there are also opposed facing strips P between blocks that assist in retaining the block construction as a single unitary piece. In FIG. 9 note the strips P between blocks L and L1 as well as between blocks L of the rear landing section and blocks B3 of the front cutout section.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A pole vault pit construction that is formed of multiple resilient foam blocks that are secured in a unitary manner and that is comprised of a front cutout section defining a recess for receiving a pole engager, said front cutout section having an open front end and an inner end, and a contiguous rear landing section, each of the front cutout section and contiguous rear landing section including a plurality of foam blocks, each of the foam blocks including a lower surface and an upper surface, adjacent ones of said foam blocks being secured together, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface on the center foam block being uninterrupted so as to form a single tapered surface at the inner end of the recess, wherein each of the pair of opposed position blocks has a member with a side edge that engages with an edge of the tapered surface of the center foam block.

2. A pole vault pit construction that is formed of multiple resilient foam blocks that are secured in a unitary manner and that is comprised of a front cutout section defining a recess for receiving a pole engager, said front cutout section having an open front end and an inner end, and a contiguous rear landing section, each of the front cutout section and contiguous rear landing section including a plurality of foam blocks, each of the foam blocks including a lower surface and an upper surface, adjacent ones of said foam blocks being secured together, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface on the center foam block being uninterrupted so as to form a single tapered surface at the inner end of the recess, wherein the blocks of the front cutout section include a front pair of blocks that have facing tapers defining a front portion of the recess and an adjacent rear pair of blocks that also have facing tapers defining a rear portion of the recess, and wherein each of the rear pair of blocks of the front cutout section also includes a member that coincides with the tapered surface of the center foam block of the rear landing section.

3. The pole vault pit construction of claim 2 wherein the height of the rear landing section is greater than the height of the front cutout section.

4. The pole vault pit construction of claim 3 wherein the member of the rear pair of blocks of the front cutout section is triangular and also includes a tapered surface that transitions from the height of the rear landing section to the height of the front cutout section.

5. A pole vault pit construction that is formed of multiple resilient foam blocks that are secured in a unitary manner and that is comprised of a front cutout section defining a recess for receiving a pole engager, said front cutout section having an open front end and an inner end, and a contiguous rear landing section, each of the front cutout section and contiguous rear landing section including a plurality of foam blocks, each of the foam blocks including a lower surface and an upper surface, adjacent ones of said foam blocks being secured together, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface on the center foam block being uninterrupted so as to form a single tapered surface at the inner end of the recess, wherein the center foam block has opposite side surfaces each coupled to a respective side landing block and a tapered surface extending away from a plane defining a front surface of each side landing block, such that the center foam block has a length greater than the side landing blocks, and wherein the center foam block has tapered side surfaces each coupled to a respective front block, each front block also configured to be coupled to the respective front surfaces of the side landing blocks.

6. The pole vault pit construction of claim 5 wherein the securing of adjacent blocks is by means of one or more buckles that connect between adjacent side walls of respective adjacent blocks.

7. The pole vault pit construction of claim 6 wherein each buckle includes a male piece and a female piece.

8. The pole vault pit construction of claim 7 wherein each buckle is disposed on an outer facing side wall of respective adjacent blocks.

9. The pole vault pit construction of claim 8 wherein the securing of adjacent blocks is further provided by adhering strips that are disposed along a top edge of adjacent blocks.

10. The pole vault pit construction of claim 9 wherein the securing of adjacent blocks is provided by having a separate adhering strip that connects across the adjacently disposed adhering strips on the top edge of adjacent blocks.

11. The pole vault pit construction of claim 10 wherein all adhering strips are hook and loop strips.

12. The pole vault pit construction of claim 6 wherein the securing of adjacent blocks is further provided by adhering strips that are disposed along a top edge of adjacent blocks.

13. The pole vault pit construction of claim 9 wherein the securing of adjacent blocks is provided by having a separate adhering strip that connects across the adjacently disposed adhering strips on the top edge of adjacent blocks.

14. The pole vault pit construction of claim 5 including a thin cover that is disposed over the pit construction.

15. A construction of a pole vault mat comprising the mat with a front cutout section defining a recess for receiving a pole engager, said front cutout section having an open front end and an inner end, and a contiguous rear landing section, each of the front cutout section and contiguous rear landing section including a plurality of foam blocks, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface of the center foam block being continuous so as to form a single tapered surface at the inner end of the recess, wherein the center foam block has opposite side surfaces each coupled to a respective side landing block and a tapered surface extending away from a plane defining a front surface of each side landing block, such that the center foam block has a length greater than the side landing blocks, and wherein the center foam block has tapered side surfaces each coupled to a respective front block, each front block also configured to be coupled to the respective front surfaces of the side landing blocks.

16. The construction of claim 15 wherein the tapered surface of the center foam block is a contiguous flat surface that defines the complete inner end of the recess.

17. The construction of claim 16 wherein the entire tapered surface of the center foam block that extends between the tapered surfaces of the opposed blocks of the front cutout section is without any gaps.

18. The construction of claim 15 wherein the securing of adjacent blocks is by means of one or more buckles that connect between adjacent side walls of respective adjacent blocks, and wherein the securing of adjacent blocks is further provided by adhering strips that are disposed along a top edge of adjacent blocks.

19. A construction of a pole vault mat comprising the mat with a front cutout section defining a recess for receiving a pole engager, said front cutout section having an open front end and an inner end, and a contiguous rear landing section, each of the front cutout section and contiguous rear landing section including a plurality of foam blocks, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface of the center foam block being continuous so as to form a single tapered surface at the inner end of the recess, and wherein the blocks of the front cutout section include a front pair of blocks that have facing tapers defining a front portion of the recess and an adjacent rear pair of blocks that also have facing tapers defining a rear portion of the recess, and wherein each of the rear pair of blocks of the front cutout section also includes a member that coincides with the tapered surface of the center foam block of the rear landing section.

20. The construction of claim 19 wherein the height of the rear landing section is greater than the height of the front cutout section, and wherein the member of the rear pair of blocks of the front cutout section is triangular and also includes a tapered surface that transitions from the height of the rear landing section to the height of the front cutout section.

21. A pole vault pit construction that is formed of multiple resilient foam blocks that are secured in a unitary manner and that is comprised of a front cutout section defining a recess for receiving a pole engager, said front cutout section having an open front end and an inner end, and a contiguous rear landing section, each of the front cutout section and contiguous rear landing section including a plurality of foam blocks, each of the foam blocks including a lower surface and an upper surface, adjacent ones of said foam blocks being secured together, said plurality of foam blocks of the front cutout section including at least one pair of opposed position blocks each having a tapered surface commencing from the upper surface downwardly to the lower surface and in a direction toward the opposed position block so that a cross-section of the recess is trapezoidal, the rear landing section including at least a center foam block having a tapered surface commencing from the upper surface downwardly to the lower surface and in a direction toward the open front end of the recess, the tapered surface on the center foam block being uninterrupted so as to form a single tapered surface at the inner end of the recess, and wherein each of the at least one pair of opposed position blocks of the front cutout section also includes a member with a side edge that coincides with the tapered surface of the center foam block of the rear landing section.

22. The construction of claim 21 wherein the blocks of the front cutout section include a front pair of blocks that have facing tapers defining a front portion of the recess and an adjacent rear pair of blocks that also have facing tapers defining a rear portion of the recess, wherein the center foam block includes an elongated segment that extends rearwardly from the tapered surface of the center foam block so as to form part of a landing surface, wherein the elongated segment and the tapered surface of the center foam block is formed as a single member, and wherein the tapered surface and the elongated segment form an uninterrupted surface therebetween.

* * * * *